US010755629B2

(12) United States Patent
Ding et al.

(10) Patent No.: US 10,755,629 B2
(45) Date of Patent: Aug. 25, 2020

(54) DISPLAY SCREEN, PIXEL DRIVING METHOD AND DISPLAY DEVICE

(71) Applicant: Yungu (Gu'an) Technology Co., Ltd., Langfang (CN)

(72) Inventors: Liwei Ding, Jiangsu (CN); Rubo Xing, Jiangsu (CN); Qi Shan, Jiangsu (CN)

(73) Assignee: YUNGU (GU'AN) TECHNOLOGY CO., LTD., Langfang, Hebei (CN)

( * ) Notice: Subject to any disclaimer, the term of this patent is extended or adjusted under 35 U.S.C. 154(b) by 0 days.

(21) Appl. No.: 16/345,998

(22) PCT Filed: Jun. 14, 2018

(86) PCT No.: PCT/CN2018/091230

§ 371 (c)(1),
(2) Date: Apr. 29, 2019

(87) PCT Pub. No.: WO2019/085489

PCT Pub. Date: May 9, 2019

(65) Prior Publication Data

US 2020/0184882 A1 Jun. 11, 2020

(30) Foreign Application Priority Data

Oct. 31, 2017 (CN) ..... 2017 1 1047037

(51) Int. Cl.
*G09G 3/3208* (2016.01)

(52) U.S. Cl.
CPC ..... *G09G 3/3208* (2013.01)

(58) Field of Classification Search
CPC .. G09G 3/3208; G09G 3/3233; G09G 3/3275; H01L 27/32
See application file for complete search history.

(56) References Cited

U.S. PATENT DOCUMENTS

2015/0294616 A1* 10/2015 Jang ..... G09G 3/3208 345/691
2015/0364075 A1 12/2015 Sato et al.
2017/0243529 A1 8/2017 Hung et al.

FOREIGN PATENT DOCUMENTS

CN 1116756 A 2/1996
CN 1637795 A 7/2005
CN 1710964 A 12/2005
CN 101191925 A 6/2008
(Continued)

OTHER PUBLICATIONS

Chinese Office Action including a Search Report.
(Continued)

*Primary Examiner* — Stacy Khoo
(74) *Attorney, Agent, or Firm* — Ladas & Parry LLP

(57) ABSTRACT

The disclosure discloses a display screen, a pixel driving method, and a display device. The display screen includes at least one display unit including a first pixel, a second pixel, and a comparator. A first input end of the comparator is coupled to a drive signal output end of the first pixel. The drive signal output end of the first pixel is used to output a first drive signal; a second input end of the comparator is coupled to a drive signal line, and the drive signal line is used to provide a second drive signal. The second drive signal is an undelayed signal. An output end of the comparator is coupled to a drive signal input end of the second pixel. The comparator is used to compare the first drive signal with the second drive signal and output a third drive signal. The third drive signal is an undelayed signal, and the third drive signal is used to drive the second pixel.

14 Claims, 4 Drawing Sheets

(56) References Cited

FOREIGN PATENT DOCUMENTS

| | | | |
|---|---|---|---|
| CN | 101425272 | A | 5/2009 |
| CN | 201293901 | Y | 8/2009 |
| CN | 102446484 | A | 5/2012 |
| CN | 104570431 | A | 4/2015 |
| CN | 205508357 | U | 8/2016 |
| CN | 106057150 | A | 10/2016 |
| CN | 107610646 | A | 1/2018 |
| EP | 2325833 | A1 | 5/2011 |
| TW | I410949 | | 10/2013 |
| TW | 201635269 | A | 10/2016 |
| TW | I583627 | | 5/2017 |

OTHER PUBLICATIONS

TW I410949 _ English Abstract.
TW I583627—Machine English Translation.
International Search Report in International Application No. PCT/CN2018/091230.
Written Opinion of the International Search Authority in International Application No. PCT/CN2018/091230.
CN 101191925 A—Machine English Translation.
CN 101425272 A—Machine English Translation.
CN 1116756 A—Machine English Translation.
CN 107610646 A—Machine English Translation.
CN 201293901Y—Machine English Translation.
CN 1710964 A—Machine English Translation.
CN 1637795 A—Machine English Translation.
CN 205508357 U—Machine English Translation.
CN 106057150 A—Machine English Translation.
CN 102446484 A—Machine English Translation.
TW 201635269 A—Machine English Translation.
CN 104570431 A—Machine English Translation.

* cited by examiner

DISPLAY SCREEN, PIXEL DRIVING METHOD AND DISPLAY DEVICE

RELATED APPLICATION

This application is an application under 35 U.S.C. 371 of International Application No. PCT/CN2018/091230 filed on 14 Jun. 2018. This application claims priority from Chinese Patent Application No. 201711047037.X filed on Oct. 31, 2017, the contents of which should he understood to be incorporated herein by reference.

FIELD OF THE DISCLOSURE

The disclosure relates to the field of display technology, and in particular to a display screen, a pixel driving method, and a display device.

BACKGROUND

Generally, an organic light-emitting display device may include a driver and a plurality of pixels, and each pixel may correspond to one pixel circuit, wherein the driver may generate a drive signal, and the drive signal may be transmitted in a plurality of pixel circuits. Each pixel circuit is scanned and data is written into each pixel circuit so that the light-emitting diodes in the pixel circuit emit light, and the entire display device emits light.

However, in practical applications, when the drive signal is transmitted from one pixel circuit to another, the drive signal may inevitably have a delay due to the resistance and the capacitance of a signal line in the pixel circuit. As the resolution of the organic light-emitting display device continues to increase, effective time for scanning each pixel by the drive signal is continuously shortened. Thus, in the case where the drive signal is delayed, the writing of data into the pixel is seriously affected, thereby affecting normal display of the entire display device.

SUMMARY

An objective of the disclosure is to provide a display screen, a pixel driving method, and a display device, which aim to solve the problem of the influence on writing of data into a pixel and abnormal display of the display device due to a delayed drive signal in the existing organic light-emitting display device.

To achieve the above objective, the disclosure provides a display screen comprising at least one display unit, the display unit comprising a first pixel, a second pixel and a comparator, wherein:

a first input end of the comparator is coupled to a drive signal output end of the first pixel, and the drive signal output end of the first pixel outputs a first drive signal;

a second input end of the comparator is coupled to a drive signal line, and the drive signal line provides a second drive signal, and the second drive signal is an undelayed signal;

an output end of the comparator is coupled to a drive signal input end of the second pixel;

the comparator compares the first drive signal with the second drive signal, and outputs a third drive signal, and the third drive signal is an undelayed signal, and the third drive signal drives the second pixel.

Optionally, the outputted third drive signal is the first drive signal, when the comparator determines the first drive signal is not delayed with respect to the second drive signal; the outputted third drive signal is the second drive signal, when the comparator determines the first drive signal is delayed with respect to the second drive signal.

Optionally, the comparator determines that the first drive signal is not delayed when simultaneously detecting a change of the first drive signal and a change of the second drive signal; the comparator determines that the first drive signal is delayed when detecting a change of the first drive signal and a change of the second drive signal at different time.

Optionally, the drive signal output end of the first pixel is coupled to the drive signal input end of the second pixel, and the first drive signal and the third drive signal jointly drive the second pixel.

Optionally, the first drive signal is one of a scan signal, a light-emitting control signal, a gate signal, and a clock signal; the second drive signal is same as the first drive signal.

Optionally, the number of the comparators comprised in the display unit is at least one, and each of the comparators outputs different third drive signals to the second pixel.

Optionally, the display unit comprises three comparators, the first pixel comprises three drive signal output ends, and the three drive signal output ends are coupled to the first input ends of the three comparators, respectively, and the second input ends of the three comparators are coupled to three drive signal lines, respectively, and the output ends of the three comparators are coupled to three drive signal input ends of the second pixel, respectively.

Optionally, the first pixel and the second pixel are two adjacent pixels located in the same row in the display screen.

Optionally, when the number of the display units comprised in the display screen is greater than 1, a plurality of display units are arranged in the display screen in columns and/or rows; for each of the plurality of display units located in the same row, at least one pixel is comprised between every two display units.

The disclosure also provides a driving method of pixels in a display screen recorded above, comprising:

comparing, by a comparator, a first drive signal outputted by a first pixel with a second drive signal inputted into the comparator to determine whether the first drive signal is delayed, the second drive signal being an undelayed signal;

inputting the first drive signal to the second pixel by the comparator when determining the first drive signal is not delayed;

inputting the second drive signal to the second pixel by the comparator when determining the first drive signal is delayed.

Optionally, the comparator determines the first drive signal is not delayed when simultaneously detecting a change of the first drive signal and a change of the second drive signal; the comparator determines the first drive signal is delayed when detecting a change of the first drive signal and a change of the second drive signal at different time.

Optionally, the first drive signal is one of a scan signal, a light-emitting control signal, a gate signal, and a clock signal; the second drive signal is same as the first drive signal.

Optionally, the number of the comparators is at least one, and each of the comparators outputs different undelayed signals to the second pixel.

The disclosure also provides a display device comprising the display screen recorded above.

The following beneficial effects can be achieved by at least one technical solution adopted by the embodiments of the disclosure:

The display screens provided by the embodiments of the disclosure include at least one display unit, and the display unit includes a first pixel, a second pixel, and a comparator, wherein: a first input end of the comparator is coupled to a drive signal output end of the first pixel, the drive signal output end of the first pixel is used to output a first drive signal; a second input end of the comparator is coupled to a drive signal line, and the drive signal line is used to provide a second drive signal, and the second drive signal is an undelayed signal; an output end of the comparator is coupled to a drive signal input end of the second pixel; the comparator is used to compare the first drive signal with the second drive signal and output a third drive signal, and the third drive signal is an undelayed signal and used to drive the second pixel. Since a comparator is added between two pixels of the display screen, the comparator may compare a drive signal outputted by one of the pixels with an undelayed drive signal and output the undelayed signal to another pixel and drive the pixel, so that since the signal for driving the pixel is an undelayed signal, it does not affect normal writing of data into the pixel, thereby ensuring normal display of the pixels and normal display of the display device.

Figure 1:
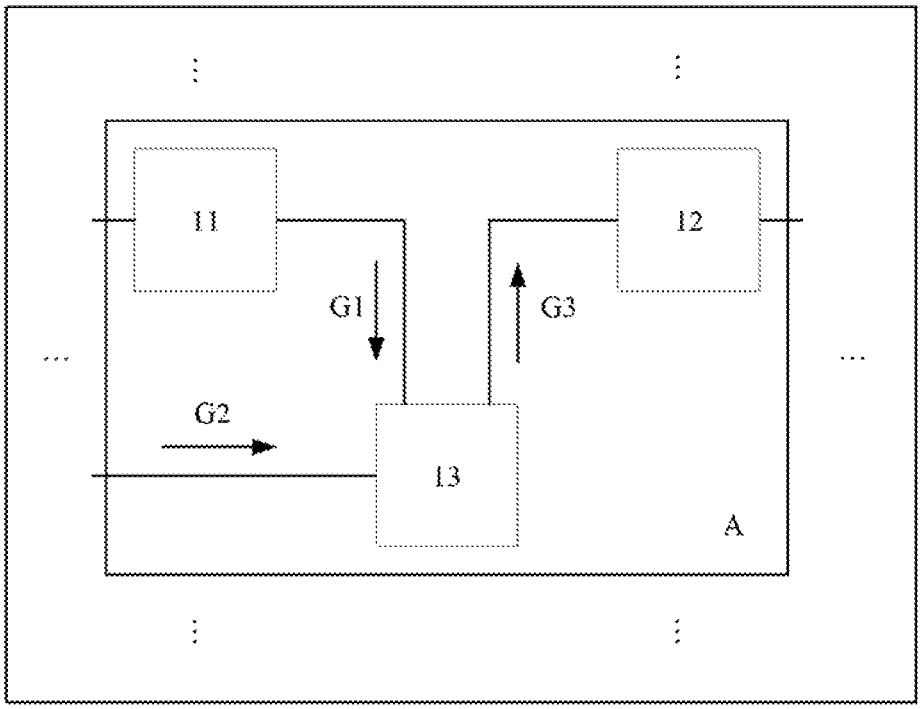
FIG. 1 is a schematic structural diagram of a display screen provided by an embodiment of the disclosure.

The achievement of the purposes, functional features and advantages of the disclosure will be further described with reference to the accompanying drawings.

DETAILED DESCRIPTION OF PREFERRED EMBODIMENTS

It should be noted that, compared with the prior art, the display screen provided by the embodiments of the disclosure adds a comparator between two pixels, and the comparator may compare a drive signal outputted by one of the pixels with an undelayed drive signal and output the undelayed signal which may be inputted to another pixel and drive the pixel. In this way, since the signal for driving the pixel is an undelayed signal, it is ensured that data is normally written into the pixel, thereby ensuring normal display of the pixels and normal display of the display device.

In various embodiments provided by the disclosure, the first drive signal may be one of a scan signal, a light-emitting control signal, a gate signal, and a clock signal in the first pixel, and the second drive signal may be a signal which is the same as the first drive signal and is not delayed. For example, if the first drive signal is the light-emitting control signal, the second drive signal is the corresponding undelayed light-emitting control signal. If the number of the scan signals, the number of the gate signals, or the number of the clock signals is multiple, the first drive signal may be one of the multiple signals, and the embodiments of the disclosure will not be specifically limited. In addition, the specific circuit structures of the first pixel and the second pixel are not limited in the embodiments of the disclosure.

The display screen provided by the embodiments of the disclosure may include at least one display unit, where the display unit may include a first pixel, a second pixel, and a comparator, and the number of the comparators may be one or more, wherein each of the comparators may be used to compare a drive signal and output a corresponding undelayed signal. Wherein, the specific number of the comparators may be determined according to the number of drive signals of the pixels in the display screen, which is not specifically limited in the embodiments.

For example, if the drive signals of the pixels in the display screen are S1, S2, and S3, the number of the comparators may be three, wherein the first comparator may be used to compare the drive signal S1 with its corresponding undelayed drive signal and output an undelayed signal, and the second comparator may be used to compare the drive signal S2 with its corresponding undelayed drive signal and output an undelayed signal, the third comparator may be used to compare the drive signal S3 with its corresponding undelayed drive signal and output an undelayed signal.

In the embodiments of the disclosure, as for the first pixel and the second pixel included in the display unit, considering that the drive signals of the pixels are generally transmitted from left to right in the display screen, and therefore, the first pixel and the second pixel may be pixels located in the same row. In other embodiments, if the drive signals in the pixels are transmitted from top to bottom in the display screen, the first pixel and the second pixel may also be pixels located in the same column. The embodiments of the disclosure are described by taking the situation in which the drive signals are transmitted from left to right in the display screen as an example. Wherein, as a preferred manner, the first pixel and the second pixel may be two adjacent pixels.

The technical solutions provided by the embodiments of the disclosure are described in detail below with reference to the accompanying drawings.

FIG. 1 is a schematic structural diagram of a display screen provided by an embodiment of the disclosure. The display screen shown in FIG. 1 may include at least one display unit A (only one display unit is shown in FIG. 1). The embodiment of the disclosure is described by taking one of the display units A as an example.

As shown in FIG. 1, the display unit A may include a first pixel 11, a second pixel 12 and a comparator 13, wherein:

The first pixel 11 may include a drive signal output end, and the drive signal output end may be used to output a first drive signal G1, wherein the first drive signal G1 may be a drive signal outputted by the first pixel 11 after driven by a drive signal outputted by an upper level pixel of the first pixel 11 (for example, a left pixel adjacent to the first pixel 11). In the embodiment of the disclosure, the first drive signal G1 may have a delay.

The second pixel 12 may include a drive signal input end through which a drive signal may be inputted to the second pixel 12 to drive the second pixel 12.

The comparator 13 may include a first input end, a second input end, and an output end, wherein:

The first input end may be coupled to the drive signal output end of the first pixel 11, such that the first drive signal G1 may be inputted to the comparator 13;

The second input end may be coupled to a drive signal line, the drive signal line may be used to provide a second drive signal G2, and the second drive signal G2 may be an undelayed signal. Wherein, as a preferred manner, the drive signal line may be a signal line coupled to a driver, and the second drive signal G2 provided by the drive signal line may not participate in driving pixels in the display screen, such that the second drive signal G2 may be regarded as an undelayed signal, wherein the driver may be used to provide a drive signal for the pixels in the display screen;

The output end may be coupled to the drive signal input end of the second pixel 12, wherein the output end may output a signal to the second pixel 12.

In the embodiment of the disclosure, the comparator 13 may compare the first drive signal G1 with the second drive signal G2 to determine whether the first drive signal G1 is delayed, and output an undelayed third drive signal G3 by the output end according to the comparison result.

When the comparator 13 determines whether the first drive signal G1 is delayed, specifically, since the drive signal of the pixel is usually a square wave signal and the square wave signal may vary between a high level and a low level, the comparator 13 may detect whether the level change of the first drive signal G1 is consistent with the level change of the second drive signal G2. If so, the first drive signal G1 and the second drive signal G2 may vary synchronously and the first drive signal G1 is not delayed; if not, it shows that the change of the first drive signal G1 is not synchronized with the change of the second drive signal G2, and the first drive signal G1 is delayed.

In the embodiment of the disclosure, if the comparator 13 determines that the first drive signal G1 is not delayed, the first drive signal G1 may be outputted by the output end. At this time, the first drive signal G1 may be regarded as the third drive signal G3; if the comparator 13 determines that the first drive signal G1 is delayed, the second drive signal G2 may be outputted by the output end, and at this time, the second drive signal G2 may be regarded as the third drive signal G3, and thus the third drive signal G3 outputted by the comparator 13 is an undelayed signal.

After the comparator 13 outputs the undelayed third drive signal G3 by the method described above, the third drive signal G3 may be inputted to the second pixel 12 and drive the second pixel 12, so that since the third drive signal G3 is the undelayed signal, it may be ensured that data is normally written into the second pixel 12 and the second pixel 12 is normally displayed.

It should be noted that in the embodiment of the disclosure, the drive signal output end of the first pixel 11 in the display unit may not be coupled to the drive signal input end of the second pixel 12, that is, the first drive signal G1 is not used to be inputted to the second pixel 12 and drive the second pixel 12, so that compared to the prior art in which the first drive signal G1 is inputted to the second pixel 12 and drive the second pixel 12, in the embodiment of the disclosure, the second pixel 12 is driven by the undelayed third drive signal G3, rather than the first drive signal G1 which may has a delay, it may be ensured that the data is normally written into a pixel circuit 12.

The display screen provided by the embodiment of the disclosure includes at least one display unit, and the display unit includes a first pixel, a second pixel, and a comparator, wherein: a first input end of the comparator is coupled to a drive signal output end of the first pixel, the drive signal output end of the first pixel is used to output a first drive signal; a second input end of the comparator is coupled to a drive signal line, and the drive signal line is used to provide a second drive signal, and the second drive signal is an undelayed signal; an output end of the comparator is coupled to a drive signal input end of the second pixel; the comparator is used to compare the first drive signal with the second drive signal and output a third drive signal, and the third drive signal is an undelayed signal and used to drive the second pixel. Since a comparator is added between two pixels of the display screen, the comparator may compare a drive signal outputted by one of the pixels with an undelayed drive signal and output the undelayed signal to another pixel and drive the pixel, so that since the signal for driving the pixel is an undelayed signal, it does not affect normal writing of data into the pixel, thereby ensuring normal display of the display device.

Figure 2:
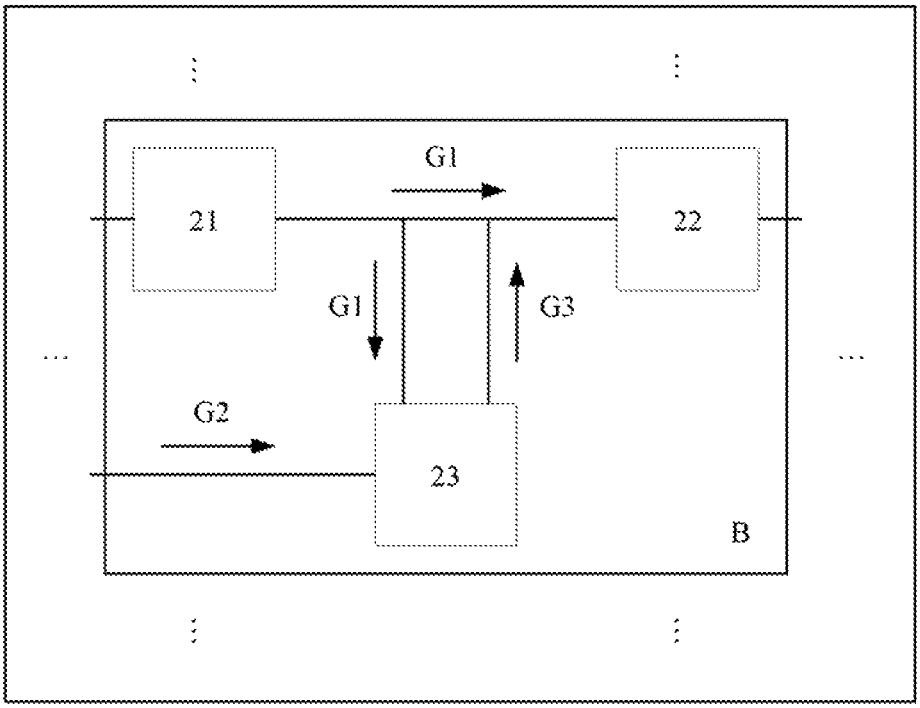
FIG. 2 is a schematic structural diagram of another display screen provided by an embodiment of the disclosure.

FIG. 2 is a schematic structural diagram of another display screen provided by an embodiment of the disclosure.

The display screen shown in FIG. 2 may include at least one display unit B, and as for one of the display units B, it may include a first pixel 21, a second pixel 22, and a comparator 23.

The function performed by the comparator 23 in FIG. 2 is the same as the function performed by the comparator 13 in FIG. 1, which will not be repeated here. A third drive signal G3 is also the same as the third drive signal G3 shown in FIG. 1, which will not be repeated here.

The display unit B shown in FIG. 2 is different from the display unit A shown in FIG. 1 in that a drive signal output end of the first pixel 21 in FIG. 2 is coupled to a drive signal input end of the second pixel 22, that is, a first drive signal G1 may be inputted to and drive the second pixel 22. In this way, after comparing the first drive signal G1 and a second drive signal G2 and outputting the third drive signal G3 by the comparator 13, the first drive signal G1 and the third drive signal G3 may jointly act on the second pixel 22, and jointly drive the second pixel 22.

Since the undelayed third drive signal G3 may ensure that the second pixel 22 is normally driven in the display unit B shown in FIG. 2, it may be ensured that the data is normally written into the second pixel 22, thereby ensuring the normal display of the second pixel 22.

It should be noted that if the first drive signals G1 in FIG. 1 and FIG. 2 are a delayed signal, comparing the display screen shown in FIG. 2 with the display screen shown in FIG. 1, since the delayed first drive signal G1 and the undelayed third drive signal G3 are used to jointly drive the second pixel 12, the display difference between the first pixel 21 and the second pixel 22 may be small, leading to more uniform display of the display screen.

In an actual application, the drive signal output end of the first pixel may be coupled to the drive signal input end of the second pixel, or may not be coupled to the drive signal input end of the second pixel, which is not specifically limited thereto herein. As a preferred manner, the drive signal output end of the first pixel may be coupled to the drive signal input end of the second pixel to ensure uniform display of the display screen.

In the display screen provided by the embodiment of the disclosure, since the comparator is added between the two pixels of the display screen, the comparator may compare the drive signal outputted by one of the pixels with the undelayed drive signal and output the undelayed signal to another pixel and drive the pixel. Thus, since the signal for driving the pixel is an undelayed signal, normal writing of data into the pixel is not affected, thereby ensuring normal display of the display device. In addition, in the display screen provided by the embodiment of the disclosure, since the first drive signal outputted by the first pixel may output to the second pixel, and drive the second pixel together with the third drive signal, the display difference between the first pixel and the second pixel may be reduced to ensure display uniformity of the display device.

Figure 3:
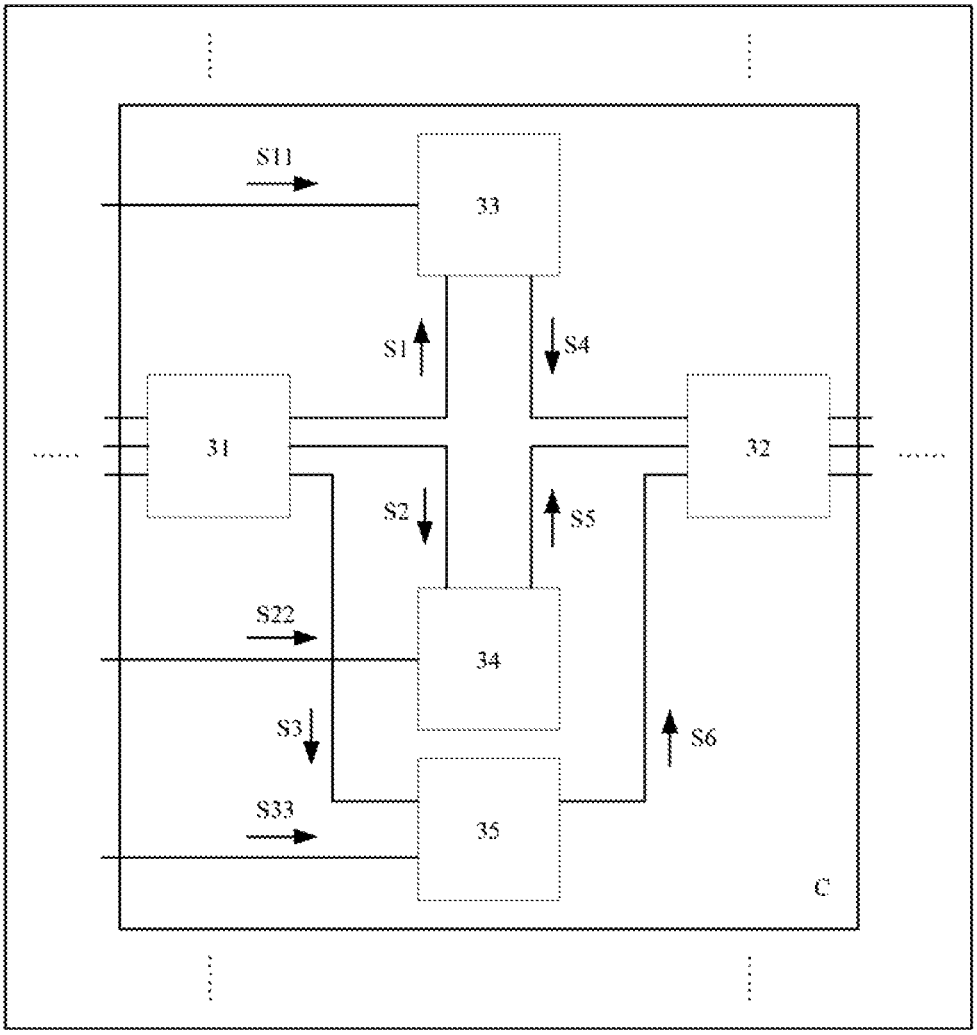
FIG. 3 is a schematic structural diagram of still another display screen provided by an embodiment of the present disclosure.

FIG. 3 is a schematic structural diagram of still another display screen provided by an embodiment of the disclosure.

In FIG. 3, the display screen may include at least one display unit C. As for one of the display units C, the display unit C may include a first pixel 31, a second pixel 32, a comparator 33, a comparator 34, and a comparator 35, wherein:

The first pixel 31 may include three drive signal output ends for outputting three drive signals: a drive signal S1, a drive signal S2 and a drive signal S3, respectively, wherein the drive signals S1, S2, and S3 may have a delay.

The second pixel 32 is a pixel adjacent to the first pixel 31 and located in the same row, and the second pixel 32 may include three drive signal input ends through which three different drive signals may be inputted, and the three different drive signals may be used to drive the second pixel 32.

In the embodiment of the disclosure, the three drive signal output ends of the first pixel 31 may not be coupled to the three drive signal input ends of the second pixel 32, that is, the drive signal S1, the drive signal S2, and the drive signal S3 are not used to input and drive the second pixel 32.

The comparator 33 may include a first input end, a second input end, and an output end. The first input end may be coupled to one of the drive signal output ends of the first pixel 31, so that the drive signal S1 outputted by the first pixel 31 is inputted to the comparator 33; the second input end may be coupled to a first drive signal line, and the first drive signal line may be used to provide a drive signal S11, and the drive signal S11 may be an undelayed signal; the output end may be coupled to one of the drive signal input ends of the second pixel 32.

The comparator 34 may include a first input end, a second input end, and an output end. The first input end may be coupled to another drive signal output end of the first pixel 31, so that the drive signal S2 outputted by the first pixel 31 is inputted to the comparator 34; the second input end may be coupled to a second drive signal line, and the second drive signal line may be used to provide a drive signal S22, and the drive signal S22 may be an undelayed signal; the output end may be coupled to another drive signal input end of the second pixel 32.

The comparator 35 may include a first input end, a second input end, and an output end. The first input end may be coupled to the last drive signal output end of the first pixel 31, so that the drive signal S3 outputted by the first pixel 31 is inputted to the comparator 35; the second input end may be coupled to a third drive signal line, and the third drive signal line may be used to provide a drive signal S33, and the drive signal S33 may be an undelayed signal; the output end may be coupled to the last drive signal input end of the second pixel 32

It should be noted that the drive signal S1 and the undelayed drive signal S11 are the same type of signal. For example, the drive signal S1 is a light-emitting control signal in the pixel, and then the drive signal S11 is an undelayed light-emitting control signal corresponding to the drive signal S1. Similarly, the drive signal S2 and the undelayed drive signal S22 are the same type of signal, and the drive signal S3 and the undelayed drive signal S33 are also the same type of signal.

In the embodiment of the disclosure, the comparator 33 may compare the drive signal S1 with the drive signal S11 by the method described in the embodiment shown in FIG. 1, and output an undelayed drive signal S4, and the drive signal S4 is inputted to the second pixel 32, and drive the second pixel 32.

The comparator 34 may compare the drive signal S2 with the drive signal S22 by the same method, and output an undelayed drive signal S5, and the drive signal S5 is inputted to the second pixel 32 and drive the second pixel 32.

The comparator 35 may also compare the drive signal S3 with the drive signal S33 by the same method, and output an undelayed drive signal S6, and the drive signal S6 is inputted to the second pixel 32 and drive the second pixel 32.

In this way, since the drive signal S4, the drive signal S5 and the drive signal S6 inputted to the second pixel 32 all are undelayed drive signals, normal writing of the data into the second pixel 32 may be ensured, thereby ensuring normal display of the second pixel 32.

The display screen provided by the embodiment of the disclosure may include a plurality of comparators, and each of the comparators may compare a drive signal with a corresponding undelayed drive signal, and output an undelayed signal to another pixel. In this way, since the drive signals inputted to the pixel are all undelayed signals, normal writing of data into the pixel may be ensured, thereby ensuring normal display of the display device.

It should be noted that, in practical applications, as for a plurality of pixels in each row of the display screen described above, one or more comparators described above may be disposed between every two adjacent pixels, wherein the number of the comparators disposed between every two adjacent pixels may be the same or different, which may be specifically determined according to actual conditions, and is not specifically limited herein. In this way, it may be effectively ensured that a drive signal inputted to each pixel is an undelayed signal, thereby ensuring the normal display of each pixel and the normal display of the entire display screen. Wherein, as for two adjacent pixels, a drive signal output end of a pixel located at the left side may or may not be coupled to a drive signal input end of a pixel located at the right side, which is not specifically limited in the embodiment of the disclosure.

Figure 4:
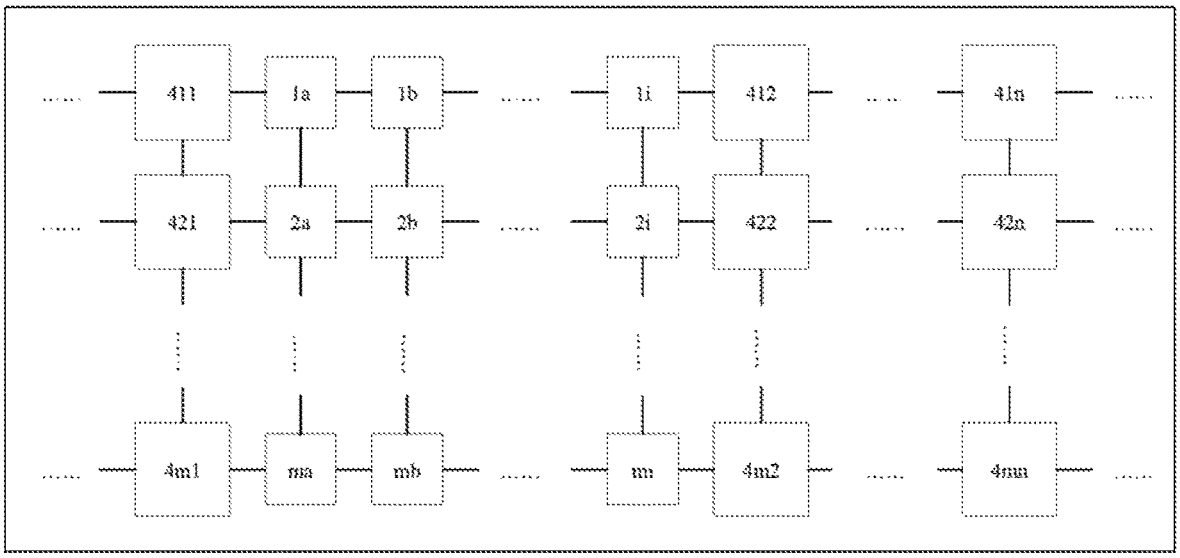
FIG. 4 is a schematic structural diagram of still another display screen provided by an embodiment of the disclosure.

FIG. 4 is a schematic structural diagram of still another display screen provided by an embodiment of the disclosure.

The display screen shown in FIG. 4 may include display units 411 to 41*n*, display units 421 to 42*n*, . . . display units 4*m*1 to 4*mn*, and these display units are arranged in an array in the display screen, wherein each of the display units shown in FIG. 4 may be the display unit A described in the embodiment shown in FIG. 1, or may be the display unit B described in the embodiment shown in FIG. 2, or may be the display unit C described in the embodiment shown in FIG. 3, which will not be specifically limited herein.

In FIG. 4, as for a plurality of display units of each row, a plurality of pixels may also be included between every two units. As shown in FIG. 4, as for the display unit 411 and the display unit 412 of the first row, 9 pixels of pixels 1*a*, 1*b*, . . . 1*i* may be included between the two display units, and as for the display unit 421 and the display unit 422 of the second row, 9 pixels of pixels 2*a*, 2*b* , . . . 2*i* may be included between the two display units, as for the display unit 4*m*1 and the display unit 4*m*2 of the m row, 9 pixels of pixels ma, mb, . . . mi may be included between the two display units.

It should be noted that in the display screen shown in FIG. 4, as for the display units located in the same row, taking the first row as an example, a drive signal inputted to a second pixel in the display unit 411 by a comparator in the display unit 411 is an undelayed signal, and the drive signal is inputted into the pixel 1*a* after transmitted in the second pixel. Since the drive signal only passes through the second pixel, the signal transmitted to the pixel 1*a* may be regarded as being undelayed, so that normal writing of data into the pixel 1*a* may be ensured, and similarly, the drive signal may also ensure normal writing of data into the pixel 1*b* to the pixel 1*i*.

Thereafter, the drive signal may be transmitted to the first pixel in the display unit 412 and transmitted in the first pixel. At this time, the drive signal may have a delay. Then, since the comparator in the display unit 412 may compare the drive signal with an undelayed drive signal and output the undelayed drive signal to the second pixel in the display unit 412, normal writing of data into the second pixel in the display unit 412 may be ensured.

In FIG. 4, a plurality of pixels may be included between the display unit 412 and the display unit 413. The left side of the display unit 411 and the right side of the display unit 41*n* may also be coupled to a plurality of pixels, respectively (not shown in FIG. 4). Based on the contents recorded above, the comparators in each display unit in the first row may ensure normal display of the pixels in the display unit and the plurality of pixels coupled to the right side thereof, thereby ensuring the normal display of all pixels in the first row. Similarly, pixels in each row may also be displayed normally, thus ensuring the normal display of the entire display.

The display screen shown in FIG. 4 may ensure the normal display of each pixel, thus ensuring the normal display of the entire display. In addition, since the display screen shown in FIG. 4 reduces the number of the comparators compared with the comparators added between every two adjacent pixels, the number of cables in the display screen may be decreased, thereby simplifying the structure of the display screen.

It should be noted that in practical applications, before fabricating the display screen, the display screen may be simulated, and one or more positions for adding a comparator in the display screen is determined. Specifically, when determining a first position for adding a comparator, the simulation may be performed based on the original display screen to determine a first pixel or a first column of pixels at which the outputted drive signal is delayed. At this time, the pixel or the column of pixels may be used as the first position for adding the comparator; when determining a second position for adding the comparator, the simulation can be performed based on the display screen in which the comparator has been added at the first position, to determine at which pixel or which column of pixels the outputted drive signal is delayed by the comparator and use the determined pixel or column of pixels as the second position, . . . , and similarly, multiple positions at which the comparators need to be added in the display screen may be determined. Thus, in the fabrication of the display screen, one or more comparators may be added at the determined positions, that is, the comparator may be only added at the position where the drive signal may be delayed in the display screen, such that the normal display of each pixel in the display screen is effectively ensured while reducing the number of the comparators and the number of the cables in the display screen, thereby further ensuring the normal display of the entire display screen and the normal display of the display device.

In practical applications, as a preferred manner, after determining the position at which the comparator needs to be added in the display screen, a comparator may be added between two adjacent columns of pixels at the position, that is, the comparators in the display screen may be arranged in columns in the display screen. Wherein, as for two adjacent pixels located in the same row, one comparator may be disposed between the two pixels, or multiple comparators may be disposed, and each of the comparators may be used to compare different types of drive signals.

Figure 5:
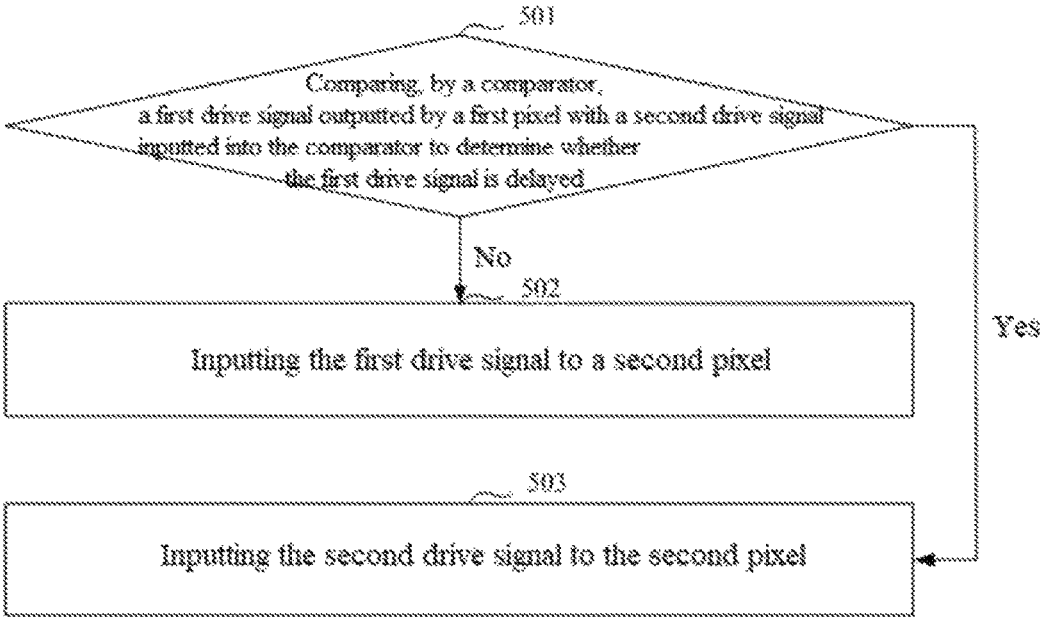
FIG. 5 is a schematic flowchart diagram of a pixel driving method provided by an embodiment of the disclosure.

FIG. 5 is a schematic flowchart diagram of a pixel driving method provided by an embodiment of the disclosure. The pixel driving method can be used to drive pixels in any one of the display screens described in the embodiments shown in FIG. 1 to FIG. 4. The driving method includes:

Step 501: comparing, by a comparator, a first drive signal outputted by a first pixel with a second drive signal inputted into the comparator to determine whether the first drive signal is delayed.

Wherein, the second drive signal is an undelayed signal.

Step 502: inputting the first drive signal to the second pixel by the comparator when determining the first drive signal is not delayed.

Step 503: inputting the second drive signal to the second pixel by the comparator when determining the first drive signal is delayed.

Specifically, as for any one of the display screens recorded in the embodiments shown in FIG. 1 to FIG. 4, during the operation of the display screen, the comparator located between the first pixel and the second pixel in the display screen may compare the first drive signal outputted by the first pixel with the second drive signal inputted to the comparator, and determine whether the first drive signal is delayed.

The method for determining whether the first drive signal is delayed may refer to the method described in the embodiment shown in FIG. 1, which will not be repeated here.

If the comparator determines that the first drive signal is not delayed, the first drive signal may be outputted to the second pixel; if the comparator determines that the first drive signal is delayed, the second drive signal may be outputted to the second pixel. In this way, normal driving of the second pixel may be ensured and normal writing of data into the second pixel may be ensured, thereby ensuring normal display of the display screen.

In the pixel driving method provided by the embodiments of the disclosure, the comparator compares the first drive signal outputted by the first pixel with the second drive signal inputted to the comparator, and determines whether the first drive signal is delayed, and the second drive signal is an un delayed signal; the first drive signal is inputted to the second pixel by the comparator when determining that the first drive signal is not delayed; the second drive signal is inputted to the second pixel by the comparator when determining that the first drive signal is delayed. Since the drive signal for driving the second pixel is an undelayed signal, normal writing of data into the second pixel is not affected, thereby effectively ensuring normal display of the display device.

The embodiments of the disclosure further provide a display device, and the display device may include the display screen described above. Since the added comparator in the display screen can ensure the normal display of each pixel in the display screen, the normal display of the display device may be ensured.

A person skilled in the art should understand that although the preferred embodiments of the disclosure have been described, the additional modifications and changes may be made to the embodiments as long as a person skilled in the art knows basic innovative concepts. Therefore, the appended claims are intended to be interpreted as including the preferred embodiments and the modifications and changes falling into the protection scope of the disclosure.

It is apparent that a person skilled in the art can make various modifications and variations to the disclosure without departing from the scope of the disclosure. Thus, if such modifications and variations of the disclosure are within the scope of the claims of the disclosure and the technical equivalents thereof, the disclosure is also intended to include such modifications and variations.

What is claimed is:

1. A display screen comprising at least one display unit, the display unit comprising a first pixel, a second pixel and a comparator, wherein:

a first input end of the comparator is coupled to a drive signal output end of the first pixel, and the drive signal output end of the first pixel outputs a first drive signal;

a second input end of the comparator is coupled to a drive signal line, and the drive signal line provides a second drive signal, and the second drive signal is an undelayed signal;

an output end of the comparator is coupled to a drive signal input end of the second pixel;

the comparator compares the first drive signal with the second drive signal, and outputs a third drive signal, and the third drive signal is an undelayed signal, and the third drive signal drives the second pixel.

2. The display screen according to claim 1, wherein, the outputted third drive signal is the first drive signal, when the comparator determines the first drive signal is nor delayed with respect to the second drive signal; or the outputted third drive signal is the second drive signal, when the comparator determines the first drive signal is delayed with respect to the second drive signal.

3. The display screen according to claim 2, wherein, the comparator determines that the first drive signal is not delayed when simultaneously detecting a change of the first drive signal and a change of the second drive signal; or the comparator determines that the first drive signal is delayed when detecting a change of the first drive signal and a change of the second drive signal at different time.

4. The display screen according to claim 1, wherein, the drive signal output end of the first pixel is coupled to the drive signal input end of the second pixel, and the first drive signal and the third drive signal jointly drive the second pixel.

5. The display screen according to claim 1, wherein, the first drive signal is one of a scan signal, a light-emitting control signal, a gate signal, and a clock signal;

the second drive signal is same as the first drive signal.

6. The display screen according to claim 5, wherein, a number of comparators comprised in the display unit is at least one, and each of the comparators outputs different third drive signals to the second pixel.

7. The display according to claim 6, wherein, the display unit comprises three comparators, the first pixel comprises three drive signal output ends, and the three drive signal output ends are coupled to first input ends of the three comparators, respectively, and second input ends of the three comparators are coupled to three drive signal lines, respectively, and output ends of the three comparators are coupled to three drive signal input ends of the second pixel, respectively.

8. The display screen according to claim 6, wherein, the first pixel and the second pixel are two adjacent pixels located in the same row in the display screen.

9. The display according to claim 8, wherein, when a number of display units comprised in the display screen is greater than 1, a plurality of display units are arranged in the display screen in columns and/or rows;

for each of the plurality of display units located in the same row, at least one pixel is comprised between every two display units.

10. A driving method of pixels in a display screen, comprising:

providing a first pixel, a second pixel and a comparator;

comparing, by the comparator, a first drive signal outputted by the first pixel with a second drive signal inputted into the comparator to determine whether the first drive signal is delayed, the second drive signal being an undelayed signal;

inputting the first drive signal to the second pixel by the comparator when determining the first drive signal is not delayed;

inputting the second drive signal to the second pixel by the comparator when determining the first drive signal is delayed.

11. The driving method according to claim 10, wherein, the comparator determines the first drive signal is not delayed when simultaneously detecting a change of the first drive signal and a change of the second drive signal;

the comparator determines the first drive signal is delayed when detecting a change of the first drive signal and a change of the second drive signal at different time.

12. The driving method according to claim 10, wherein, the first drive signal is one of a scan signal, a light-emitting control signal, a gate signal, and a clock signal;

the second drive signal is same as the first drive signal.

13. The driving method according to claim 10, wherein, a number of comparators is at least one, and each of the comparators outputs different undelayed signals to the second pixel.

14. A display device comprising a display screen, the display screen comprising at least one display unit, the display unit comprising a first pixel, a second pixel and a comparator, wherein:

a first input end of the comparator is coupled to a drive signal output end of the first pixel, and the drive signal output end of the first pixel outputs a first drive signal;

a second input end of the comparator is coupled to a drive signal line, and the drive signal line provides a second drive signal, and the second drive signal is an undelayed signal;

an output end of the comparator is coupled to a drive signal input end of the second pixel;

the comparator compares the first drive signal with the second drive signal, and outputs a third drive signal, and the third drive signal is an undelayed signal, and the third drive signal drives the second pixel.

* * * * *